US008183784B2

(12) United States Patent
Willaert et al.

(10) Patent No.: US 8,183,784 B2
(45) Date of Patent: May 22, 2012

(54) INTEGRATED LIGHTING CONTROL MODULE AND POWER SWITCH

(75) Inventors: Wouter Lambertus Petrus Willaert, Eindhoven (NL); Dennis Van De Meulenhof, Eindhoven (NL); Ian McClelland, Eindhoven (NL); Ay Ling De Goederen, Eindhoven (NL); Paul Philip Thursfield, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 704 days.

(21) Appl. No.: 12/299,655

(22) PCT Filed: May 2, 2007

(86) PCT No.: PCT/IB2007/051639

§ 371 (c)(1),
(2), (4) Date: Nov. 5, 2008

(87) PCT Pub. No.: WO2007/132383

PCT Pub. Date: Nov. 22, 2007

(65) Prior Publication Data

US 2009/0179596 A1 Jul. 16, 2009

(30) Foreign Application Priority Data

May 11, 2006 (EP) ..... 06113822

(51) Int. Cl.
*H05B 37/02* (2006.01)

(52) U.S. Cl. ..... 315/149

(58) Field of Classification Search ..... 315/149, 315/312–313, 315–316, 321–324, 360, 362
See application file for complete search history.

(56) References Cited

U.S. PATENT DOCUMENTS

| | | | | |
|---|---|---|---|---|
| 4,879,495 | A * | 11/1989 | Yamamoto | 315/362 |
| 5,798,620 | A * | 8/1998 | Wacyk et al. | 315/307 |
| 5,808,423 | A * | 9/1998 | Li et al. | 315/313 |
| 7,247,999 | B2 * | 7/2007 | Kumar | 315/291 |
| 7,372,355 | B2 * | 5/2008 | Agronin et al. | 337/126 |
| 2002/0180367 | A1 | 12/2002 | Logan | |
| 2003/0057887 | A1 | 3/2003 | Dowling et al. | |
| 2004/0202011 | A1 * | 10/2004 | Lee | 362/802 |

FOREIGN PATENT DOCUMENTS

| | | | |
|---|---|---|---|
| FR | 2813136 | | 2/2002 |
| GB | 2151115 | A | 7/1985 |
| WO | 9827792 | | 6/1998 |
| WO | 0135181 | A1 | 5/2001 |
| WO | 0184688 | A2 | 11/2001 |
| WO | 02062106 | A1 | 8/2002 |
| WO | 2004103029 | A1 | 11/2004 |

* cited by examiner

*Primary Examiner* — Shawki S Ismail
*Assistant Examiner* — Thienvu Tran
(74) *Attorney, Agent, or Firm* — Dicran Halajian; Mark Beloborodov

(57) ABSTRACT

A lighting system includes a light source and a switch configured to receive input power and provide switched power. A control module is configured to receive the switched power and control the light source. The control module is further configured to provide the switched power to the light source in response to toggling the switch more than once within a predetermined time period.

14 Claims, 2 Drawing Sheets

INTEGRATED LIGHTING CONTROL MODULE AND POWER SWITCH

This application is a national stage application under 35 U.S.C. §371 of International Application No. PCT/IB2007/051639 filed on May 2, 2007, and published in the English language on Nov. 22, 2007 as International Publication No. WO/2007/132383, which claims priority to European Application No. 06113822.8, filed on May 11, 2006, incorporated herein by reference.

The present invention relates to lighting systems and methods for turning lights on in response to toggling a switch more than once within a predetermined time period, for example.

FIGS. 1-2 show typical lighting systems 100, 200, respectively. Such original lighting systems in homes or businesses are wired systems, where a switch 110, 210 is wired to the main power, e.g., 110 VAC in the United States and 220 VAC in many other countries. The switch 110, 210 is further connected by wires 115, 215 to a light source or luminaire 120, 220 including the light source, such as the luminaire 120 located in the ceiling shown in FIG. 1. In addition or alternatively, as shown in FIG. 2, the switch 210 may also be connected by wires 215 to a wall outlet 230, referred to as a switched outlet. In this case, the light source/luminaire 220 is plugged into the switched outlet 230. Toggling the switches 110, 210 ON/OFF turns ON/OFF the power and thus the light sources 120, 220.

New home lighting control systems are being added to provide further flexibility, such as remotely turning the lights ON/OFF. Most new home lighting control systems are being installed by the consumer instead of a professional installer. The consequence is that the existing/original lighting system is not linked to the new system. As the original lighting system is extended, more and more problems arise due to having the existing/original lighting control system in parallel with the additional control and/or lighting system without effectively linking the two systems. The addition of lighting controls without effective integrations with the existing controls causes user confusion and difficulties in controlling the lights via both the original and the new lighting control systems.

For example, if a light source is switched via an original switch 110, 210 (as shown in FIGS. 1-2), and the consumer replaces the light source with a new module that enables (remote) control of the light source connected to the new module, the power to the new module will be provided through the switch 110, 210. The switch 110, 210 provides switched power from the main power (e.g., 110 VAC) or from other sources such as a DC power converted/derived from the main power. Toggling the switch 110, 210 OFF to turn off the lights 120, 220 will also turn off power to the new module thus potentially causing problems.

The problem and confusion become even bigger for the consumer if there are guests who are not familiar with the new lighting control system. The guests will expect that the light (s) of a dark room will go on by toggling once the switch that is normally around the corner of the door, as shown in FIGS. 1-2. Not knowing about a new light control system, the guests will be surprised to see that the light does not go on when the switch 110, 220 is toggled once to the ON position, for example. Thus, the benefit of having a system installed by the consumer instead of a professional installer, for example, introduces problems such as the above-described problem including powering off the new control system and rendering it inoperative (as will be described), as well as not being able to turn the lights ON, when the wall switch 110, 220 is toggled once to the supposedly ON position.

Accordingly, there is a need for a new lighting control system which is easy to install and use, and which minimizes user confusion. Thus, one object of the present system and method is to provide lighting controls which is intuitive to use and simple to install.

This and other objects are achieved by systems and methods that include a light source and a switch configured to receive input power and provide switched power. A control module is configured to receive the switched power and control the light source. The control module is further configured to provide the switched power to the light source in response to toggling switch more than once, namely twice for example, within a predetermined time period.

The present systems and methods make use of the expected behavior of the end-user, e.g., when the intent is to switch on a light. When the light is off, and the user wants to switch on the light(s), the user will toggle the light switch once. If the power of the new light control module is cut-off or interrupted in response to toggling the light switch once, then the light(s) will not turn on and will stay off, even when a remote controller associated with the new light control module is activated. However, the typical user will toggle the light switch again since the user will not understand why the light(s) did not switch on. The control module will detect this sequence of toggling the switch more than once, and turn on the light(s).

Further areas of applicability of the present systems and methods will become apparent from the detailed description provided hereinafter. It should be understood that the detailed description and specific examples, while indicating exemplary embodiments of the systems and methods, are intended for purposes of illustration only and are not intended to limit the scope of the invention.

These and other features, aspects, and advantages of the apparatus, systems and methods of the present invention will become better understood from the following description, appended claims, and accompanying drawing where:

The following description of certain exemplary embodiment(s) is merely exemplary in nature and is in no way intended to limit the invention, its application, or uses. In the following detailed description of embodiments of the present systems and methods, reference is made to the accompanying drawings which form a part hereof, and in which are shown by way of illustration specific embodiments in which the described systems and methods may be practiced. These embodiments are described in sufficient detail to enable those skilled in the art to practice the presently disclosed system and it is to be understood that other embodiments may be utilized and that structural and logical changes may be made without departing from the spirit and scope of the present system.

The following detailed description is therefore not to be taken in a limiting sense, and the scope of the present system is defined only by the appended claims. The leading digit(s) of the reference numbers in the figures herein typically correspond to the figure number, with the exception that identical components which appear in multiple figures are identified by the same reference numbers. Moreover, for the purpose of clarity, detailed descriptions of well-known devices, circuits, and methods are omitted so as not to obscure the description of the present system.

Figure 3:
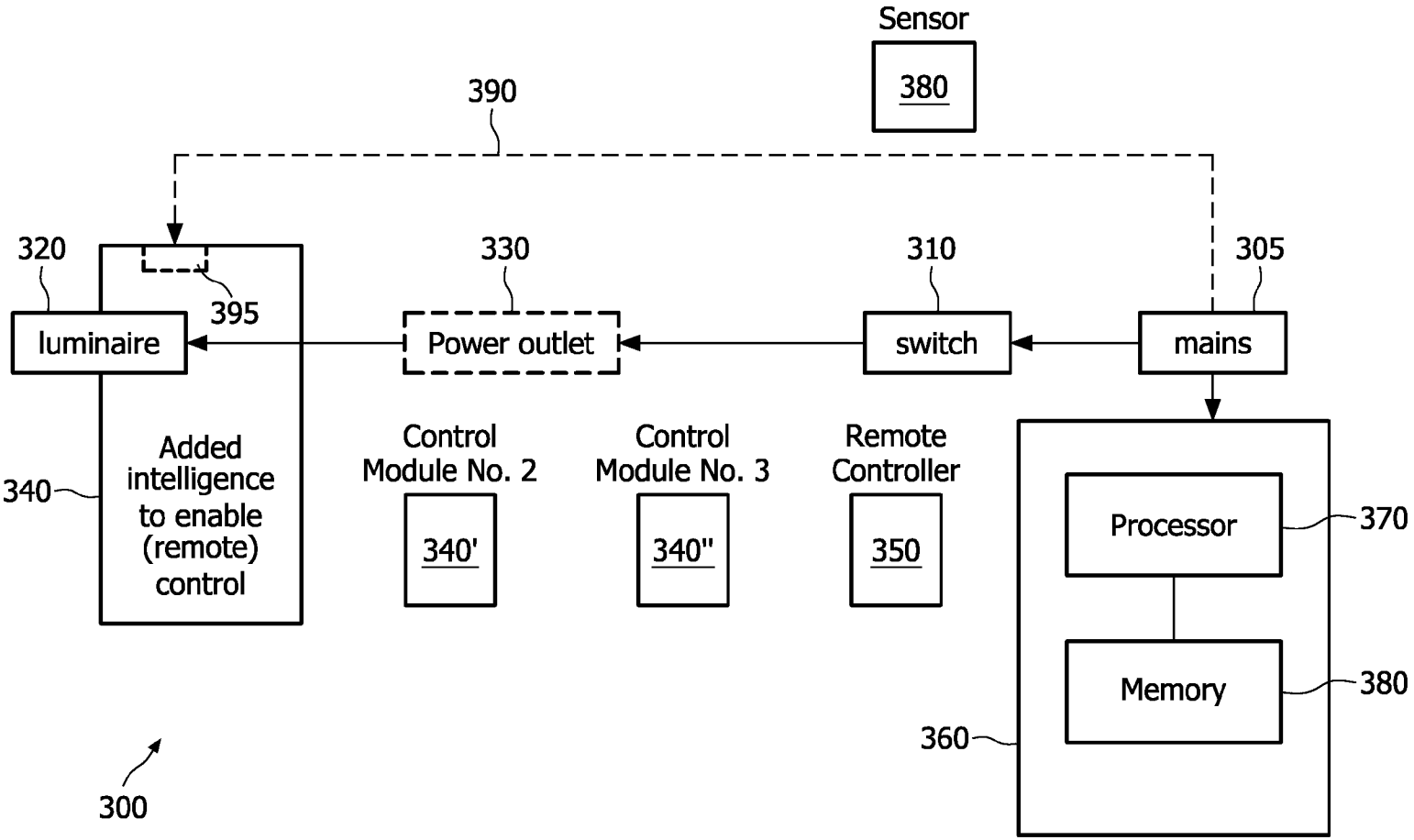
FIG. 3 shows lighting systems according to one embodiment.

FIG. 3 shows a lighting system 300 according to one embodiment including an intelligent control module 340. In particular, a switch 310 is configured to switch power ON/OFF in response to being toggled. Illustratively, the switch 310 switches power provided from a main power source 305, such as 110 VAC or 220 VAC. Of course, any other power type or source may be switched by the switch 310.

Figure 1:
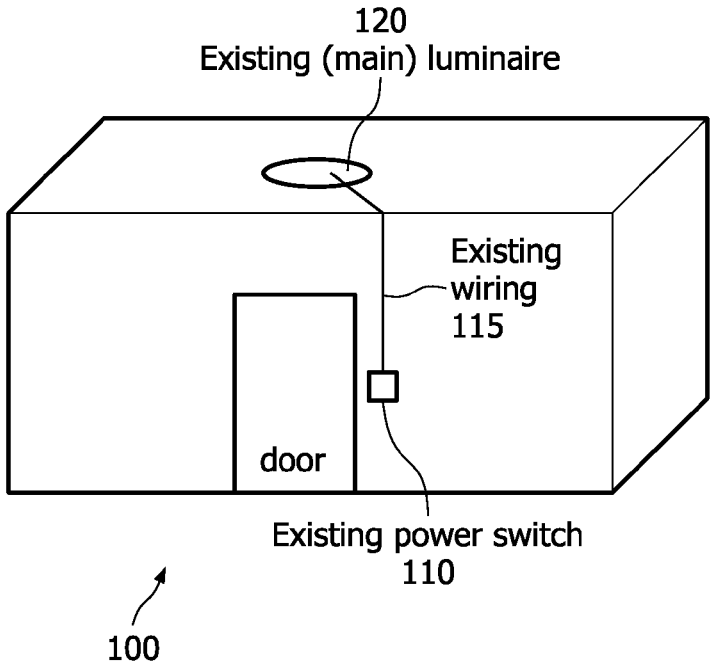
FIG. 1 shows a typical lighting system.
Figure 2:
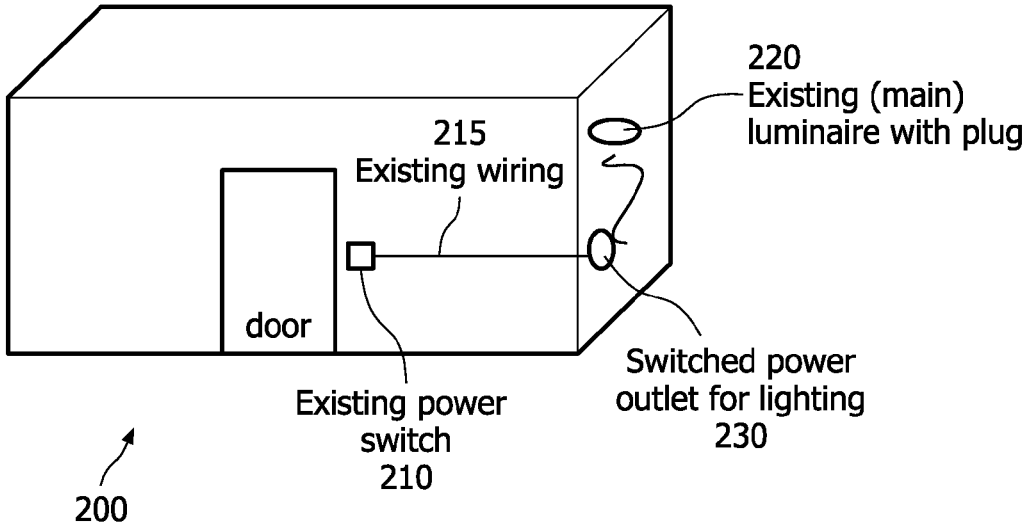
FIG. 2 shows another typical lighting system.

The output of the switch 310, referred to as switch power, is provided directly to the control module 340. Alternatively, the switch power may be provided to a power outlet 330, which may be a wall switched power outlet, similar to the switched power outlet 230 shown in FIG. 2 for example. The optional switched power outlet 330 is shown in dashed lines in FIG. 3. The control module 340 receiving the switch power is connected to a light source or luminaire including or housing the light source 320. Illustratively, the control module 340 is configured to be attachable to the luminaire, such as screwed into the luminaire, instead of the light source. In turn, the light source is attachable, e.g., screwed into the control module 340, thus providing a simple installation.

The control module 340 is configured to control the light or lights 320 connected thereto independent from the switch 310. For example, the lights 320 are turned on by the switch 310, which may be the original switch included in the original lighting system. The control module 340 may be controlled by a remote controller 350 for example. The control module 340 and remote controller 350 may be linked or communicate via any communication link, such as wired or wireless. Of course, wireless communication is more convenient, as it does not require adding wires to connect control module 340 to the remote controller 350 and/or to a further switch. The wireless communication may be by any suitable means, such as via radio frequency (RF), infrared (IR), sonar, optical etc. For example, short range wireless protocols may be used, such as Bluetooth, Zigbee, Z-wave, X10 etc.

Of course, as it would be apparent to one skilled in the art of communication in view of the present description, various elements may be included in the control module 340 and remote controller 350, such as one or more transmitters, receivers, or transceivers, antennas, modulators, demodulators, converters, duplexers, filters, multiplexers etc., which will not be further described in order not to obscure description of the present system and method. A system controller 360 including a processor 370 and memory 381 may also be provided where the processor executes instruction stored in the memory, which may also store other data, such as predetermined or programmable settings related to control of the light sources, including programmable times to turn the lights on/off, and change light attributes, such as intensity (i.e., dimming function), color, hue, saturation and the like, for the case of light source that may be controlled to change attributes of light emanating therefrom.

It should be understood that the various component of the lighting system 300 may be operationally coupled to each other (including the system controller 360) by any type of link, including wired or wireless link(s), for example. For example, the switch 310 may be wirelessly controlled by its own remote controller to provide the switched power. Further, alternatively or in addition to the remote controller 350, further units may be configured to communicate with and control the control module 340. Such further units may be one or more of the following units: a personal digital assistant (PDA), mobile phone, laptop or personal computer, etc., which may act or be programmed to act as the system controller 360 and/or the remote controller 350.

Light emitting diodes (LEDs) are light sources that are particularly well suited to controllably provide light of varying attributes, as LEDs may easily be configured to provide light with changing colors, intensity, hue, saturation and other attributes, and typically have electronic drive circuitry for control and adjustment of the various light attributes. However, any controllable light source may be used that is capable of providing lights of various attributes, such as various intensity levels, different colors, hue, saturation and the like, such as incandescent, fluorescent, halogen, or high intensity discharge (HID) light and the like, which may have a ballast or drivers for control of the various light attributes.

The following scenario is described to better understand the present lighting system and method. Assume that in a room, the light or lights 320 connected to the control module 340 are turned ON by the switch 310, but later are turned OFF by the control unit 340, e.g., under the control of the remote controller 350. In this case, the switch 310 is in the ON position, thus providing switched power to the control module 340, but the lights 320 are OFF. A user enters the room, e.g., when it's dark, and wishes to turn the lights on. The user touches the wall near the door where light switches are typically located, looking for the light switch 310 (e.g., in the dark).

The user finds the wall switch 310 and toggles it to switch ON the light(s) 302. As the previous state of the wall switch 310 was ON, toggling the wall switch 310 will turn off the switched power, thus cutting off the power or powering off the intelligent control module 340. Of course, the lights will not turn on. The user, perhaps confused, toggles the switch 310 again, which is a typical reaction in such a scenario when a switch is toggled expecting to turn on the lights, yet the lights do not turn on.

The intelligent light switch or control module 340 recognizes the intent of the user to turn on the lights and thus does turn on the lights 320. Such a reaction or recognition of the control module 340 may be based on one or more parameters, such as based on the sequence of toggling the switch 310 more than once, such as twice, in a predetermined time period. This switching sequence parameter (e.g., switched twice in a short time) may be combined for better results with one or more other parameters such as:

(a) The time period of the power interrupt/switch off of the control module 340 due to the first toggle of the switch 310 when the user entered the room and intended to turn on the lights 320. Any suitable power-interrupt time period may be used, which may be predetermined and/or programmable. For example, the predetermined control module's 340 power-interrupt time period may be between 100 milli-seconds (ms) and one second.

Such a time period (or another time period may be used which) is suitable to filter out power glitches, such as off transients where power is interrupted for a short time period due to reasons external to the lighting system, e.g., due to short power interruption of the power supplied to the main 305 e.g., due to lightning, as well as transient surges or spikes, and/or situations where the switch 310 was purposely switched off to remove power from the control module 340.

Thus, upon detection of a sequence of toggles of the switch 310, such as two toggles or more, within this time period, the control module 340 switches on the lights 320. In the case where the sequence of toggles leaves the switch 310 in the OFF position, thus cutting off the power to the control module 340, the control module 340 or other components, such as the system controller 360 may activate the switch 310 (in the case the switch 310 is configured to be controlled remotely), or activating a switched port 395 of the control module 340 for receiving power from the main power source 305, thus providing switched power to the control unit 340, which in turn provides the switched power to the light(s) 320 thus turning on the light(s) 320.

(b) The fact that only one control module 340 out of a plurality of control modules 340', 340" which are in communication with each other, or monitored by the system controller 360, is switched off and on, while the other control modules are not switched off and on, is used to rule out power drop outs, which would cut-off power to all the control modules. Of course, alternatively or in addition, the power from the main 305 may be monitored to determine a power drop out, or power outage, by the system controller 360 and for the control module 340.

(c) The fact that it was dark when the user toggled the switch 310 upon entry into the room. A sensor 380 in communication (wired or wireless) with the control module 340 and/or the system controller 360 may be used to detect darkness. The sensor 380 may be integrated with the control module 340 and/or the system controller 360. Of course, the state of the light source 320 may be detected where an OFF state is interpreted as the room being 'dark' (even if not so). More particularly, such an interpretation is likely to yield the correct intent of the user, namely, to turn the lights on (whether the room is dark or not).

Accordingly, the system and method will switch on the light, e.g., in a default setting such as a default intensity and the like, based on the conclusion that the user wanted or intended to turn the lights on.

Various modifications may also be provided as recognized by those skilled in the art in view of the description herein. The memory 381 may be any type of device for storing application data as well as other data. The application data and other data are received by the system controller 360 or processor 370 for configuring it to perform operation acts in accordance with the present systems and methods.

The operation acts of the present methods are particularly suited to be carried out by a computer software program, such computer software program preferably containing modules corresponding to the individual steps or acts of the methods. Such software can of course be embodied in a computer-readable medium, such as an integrated chip, a peripheral device or memory, such as the memory 381 or other memory coupled to the processor 370 of the system controller 360 or a processor of the control module 340.

The computer-readable medium and/or memory 381 may be any recordable medium (e.g., RAM, ROM, removable memory, CD-ROM, hard drives, DVD, floppy disks or memory cards) or may be a transmission medium (e.g., a network comprising fiber-optics, the world-wide web, cables, and/or a wireless channel using, for example, time-division multiple access, code-division multiple access, or other wireless communication systems). Any medium known or developed that can store information suitable for use with a computer system may be used as the computer-readable medium and/or memory 381.

Additional memories may also be used. The computer-readable medium, the memory 381, and/or any other memories may be long-term, short-term, or a combination of long-and-short term memories. These memories configure the processor 370 to implement the methods, operational acts, and functions disclosed herein. The memories may be distributed or local and the processor 370, where additional processors may be provided, may be distributed or singular. The memories may be implemented as electrical, magnetic or optical memory, or any combination of these or other types of storage devices. Moreover, the term "memory" should be construed broadly enough to encompass any information able to be read from or written to an address in the addressable space accessed by a processor. With this definition, information on a network is still within memory 381, for instance, because the processor 370 may retrieve the information from the network.

The processor 370 and memory 381 may be any type of processor/controller and memory, such as those described in U.S. 2003/0057887, which is incorporated herein by reference in its entirety. The processor 370 is capable of providing control signals and/or performing operations in response to detecting a sequence of toggles of the switch 310, and executing instructions stored in the memory 381. The processor 370 may be an application-specific or general-use integrated circuit(s). Further, the processor 370 may be a dedicated processor for performing in accordance with the present system or may be a general-purpose processor wherein only one of many functions operates for performing in accordance with the present system. The processor may operate utilizing a program portion, multiple program segments, or may be a hardware device utilizing a dedicated or multi-purpose integrated circuit. Each of the above systems utilized for identifying the presence and identity of the user may be utilized in conjunction with further systems.

Of course, it is to be appreciated that any one of the above embodiments or processes may be combined with one or with one or more other embodiments or processes to provide even further improvements in finding and matching users with particular personalities, and providing relevant recommendations.

Finally, the above-discussion is intended to be merely illustrative of the present system and should not be construed as limiting the appended claims to any particular embodiment or group of embodiments. Thus, while the present system has been described in particular detail with reference to specific exemplary embodiments thereof, it should also be appreciated that numerous modifications and alternative embodiments may be devised by those having ordinary skill in the art without departing from the broader and intended spirit and scope of the present system as set forth in the claims that follow. The specification and drawings are accordingly to be regarded in an illustrative manner and are not intended to limit the scope of the appended claims.

In interpreting the appended claims, it should be understood that:

a) the word "comprising" does not exclude the presence of other elements or acts than those listed in a given claim;

b) the word "a" or "an" preceding an element does not exclude the presence of a plurality of such elements;

c) any reference signs in the claims do not limit their scope;

d) several "means" may be represented by the same item or hardware or software implemented structure or function;

e) any of the disclosed elements may be comprised of hardware portions (e.g., including discrete and integrated electronic circuitry), software portions (e.g., computer programming), and any combination thereof, f) hardware portions may be comprised of one or both of analog and digital portions;

g) any of the disclosed devices or portions thereof may be combined together or separated into further portions unless specifically stated otherwise; and h) no specific sequence of acts or steps is intended to be required unless specifically indicated.

The invention claimed is:

1. A lighting system comprising:

a light source having an ON state for providing illumination and an OFF state;

a switch having an ON position and an OFF position, said switch being configured to receive input power and provide switched power, wherein said switch is configured to switch said light source to the OFF state when said switch is in said OFF position;

a control module having a power input and configured to receive said switched power at the power input and control said light source by switching said light source between said ON state and said OFF state when said switch is toggled to said ON position to turn said light source on and off independent from said switch;

a system controller configured to activate said switch to provide said switched power to said control module and turn on said light source when said light source is in said OFF state, said switch is in said ON position, and said switch is subsequently toggled more than once within a predetermined time period, wherein said predetermined time period is selected to filter out power glitches interrupting said input power; and a sensor configured to detect a reduced illumination of an environment of at least one of said light source and said switch.

2. The lighting system of claim 1, wherein said predetermined time period is between 100 ms and one second.

3. The lighting system of claim 1, wherein said control module is further configured to provide said switched power to said light source when said environment of said at least one of said light source and said switch has said reduced illumination.

4. The lighting system of claim 1, where said control module is further configured to provide said switched power to said light source when said input power remains continuously on.

5. The lighting system of claim 1, further comprising a system controller configured to monitor power input of said control module and of said at least one additional control module.

6. The light system of claim 1, further comprising a remote controller configured to control said control module to switch on/off said light source.

7. A lighting system comprising:

a light source;

a switch configured to receive input power and control said light source;

a control module configured to receive switched power from the switch and control said light source when said switch is in an ON position to provide said switched power;

a system controller configured to activate said switch to provide said switched power to said control module and turn on said light source when said light source is in an OFF state, said switch is in said ON position, and said switch is sequentially toggled within a predetermined time period, wherein said predetermined time period is selected to filter out power glitches interrupting said input power; and a sensor configured to detect a reduced illumination of an environment of at least one of said light source and said switch.

8. The lighting system of claim 7, wherein said switch is configured to provide said switched power.

9. The light system of claim 7, wherein said predetermined time period is between 100 ms and one second.

10. The lighting system of claim 7, wherein said control module is further configured to provide said switched power to said light source when said environment of said at least one of said light source and said switch has said reduced illumination.

11. The lighting system of claim 7, wherein said control module is further configured to provide said switched power to said light source when said input power remains continuously on.

12. The lighting system of claim 7, further comprising a system controller configured to monitor power input of said control module and of said at lease one additional control module.

13. The lighting system of claim 7, further comprising a remote controller configured to control said control module to switch on/off said light source.

14. A method of controlling a light source comprising the acts of:

providing a switch configured to receive input power and control the light source;

providing a control module configured to receive switched power from the switch and control the light source when the switch is in an ON position to provide the switched power;

providing a system controller configured to activate the switch to provide the switched power to the control module and turn on the light source when the light source is in an OFF state, the switch is in the ON position, and the switch is sequentially toggled within a predetermined time period, wherein the predetermined time period is selected to filter out power glitches interrupting the input power; and sensing a reduced illumination of an environment of at least one of the light source and the switch.

* * * * *